United States Patent [19]

Napper

[11] 4,394,805

[45] Jul. 26, 1983

[54] ESCAPABLE-WINDOW-SECURITY-GUARD SYSTEM

[76] Inventor: Roger L. Napper, 2064 Rainier Ave., Bel Air, Md. 21014

[21] Appl. No.: 257,331

[22] Filed: Apr. 24, 1981

[51] Int. Cl.[3] ..... E06B 3/68

[52] U.S. Cl. ..... 49/55; 49/57; 49/141

[58] Field of Search ..... 49/55, 56, 57, 50, 141, 49/463, 465, 399

[56] References Cited

U.S. PATENT DOCUMENTS

| | | | |
|---|---|---|---|
| 1,854,153 | 4/1932 | Ammon | 49/56 |
| 1,902,949 | 3/1933 | Condon | 49/57 |
| 2,668,729 | 2/1954 | Watters | 49/141 X |
| 4,106,238 | 8/1978 | Bonello | 49/399 X |
| 4,130,966 | 12/1978 | Kujawa et al. | 49/141 |

*Primary Examiner*—Kenneth Downey
*Attorney, Agent, or Firm*—John F. McClellan, Sr.

[57] ABSTRACT

An escapable guard system includes means for security of a grill having at each side thereof to be attached to a window frame or the like a channel with legs outturned; for co-acting with channels of this type a self-protective fastening system is provided which on unlocking provides instant full access to the window opening; the fastening system includes for one side of such a grill an angled guard latch which fits within a channel where it is secured by carriage bolts passing through respective square holes in the channel and into square holes in base members of this invention which the square under-portion of each rounded head of the carriage bolt type machine screw fits, leaving exposed only the featureless semi-spherical portion of the bolt head; this guard latch co-acts with a frame latch which covers the nuts on the carriage bolts when attached to a window frame and which can be locked to the guard latch by a padlock; for the other side of such a grill similarly secured hinge hooks are provided which have angled portions for detachably securing through openings in respective hinge catch plates in such manner that it is only necessary to unlock the grill to remove it entirely, if desired.

4 Claims, 2 Drawing Figures

ESCAPABLE-WINDOW-SECURITY-GUARD SYSTEM

FIELD OF THE INVENTION

This invention relates generally to fastenings for structural guards over openings in buildings and the like and particularly to a system, which may be provided in kit form, rendering a window security guard escapable on short notice.

BACKGROUND OF THE INVENTION

In the prior art various window guards have been disclosed including those in the following U.S. patents:

U.S. Pat. No. 1,662,167 granted to O. M. Rexinger on Mar. 13, 1928, disclosed an expansible grating window guard with side members in the form of channels with out-turned legs;

U.S. Pat. No. 1,854,153 granted to W. W. Ammen on Apr. 12, 1932, disclosed a removable window guard which can be locked in place and which shields the attachment bolts;

U.S. Pat. No. 1,902,949 granted to J. P. Condon on Mar. 28, 1933, disclosed a window guard with a channel frame and means for detachably locking it in place in a window.

U.S. Pat. No. 3,738,062 granted to H. A. Ughi on June 12, 1973, discloses a telescoping frame, hinged to a window and lockable in place with evidently some limitation of access to the fastener.

From these prior art patents it can be seen that an easily installed, low-cost, high protection, securely lockable but simply and instantly jettisonable window guard or the like which provides full access, would be highly desirable.

OBJECTS OF THE PRESENT INVENTION

However, it is believed that none of the above-referenced devices nor any others presently available provide the advantages of the present invention according to objects thereof, principal objects being:

to provide an escapable window guard system which in combination or kit form is adjustable to fit most applications;

which when unlocked swings free and provides full access through the opening, and is readily detachable for maintenance and the like;

which protects the fasteners in such way as to make the system resistant to attack by saw, wrench or other tools;

which is easy and quick to install, requires no close tolerances, which requires only simple punching operations and little or no welding to make, which is economical to purchase;

which can be made in small sizes and in large sizes and can be applied in groups to cover particular openings;

which is applicable facing inside or out, which hinges at either side, which employs in a new way simple hinging means of a type easily produceable;

which is easy to lock and to unlock, which can be installed substantially rattle-free, which can serve as its own template for installation purposes; and which is attractive in appearance.

BRIEF SUMMARY OF THE INVENTION

In brief summary given as cursive description only and not as limitation, the invention includes: (a) for mounting at one side of a grill, angle latch structure proportioned for securance in a channel recess by carriage-type bolts with featureless heads in the anti-turning coaction with structure of the invention; nuts on the carriage type bolts are shielded by a frame latch which also serves for padlocking to the guard latch structure; (b) for mounting at the other side of a grill, similarly-secured hinge hooks engage window-frame-fastened hinge plates which shield the nuts on the carriage type bolts holding the hinge hooks.

BRIEF DESCRIPTION OF THE DRAWINGS

The above and other objects and advantages of the invetnion will become more readily understood on examination of the following description, including the drawings in which like characters refer to like parts.

DETAILED DESCRIPTION OF THE DRAWINGS

Figure 1:
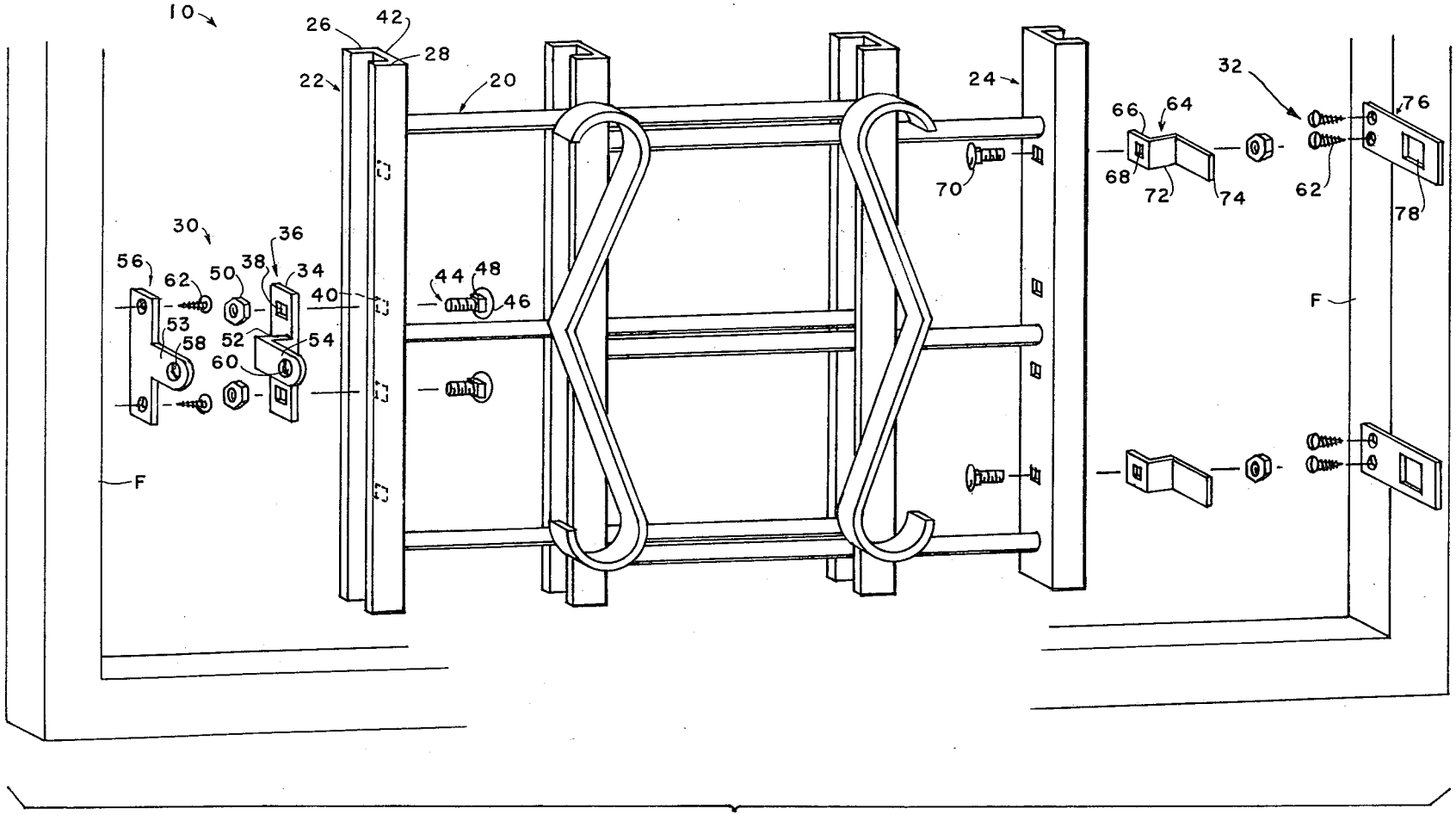
FIG. 1 shows the invention in an exploded elevational perspective view with separated portions of frame structure fragmentarily illustrated, and parts exaggerated in size, for exposition.

FIG. 1 shows the combination 10 of this invention in the form of a rectangular grill 20 with at each side thereof a channel 22, 24, each with legs 26, 28 out-turned.

A locking means 30 and a releasible storm-window type hinging means 32 secure the channels as follows; when unlocked and pivoted on the hinge to a position in which the grill is substantially perpendicular to the window frame the grill automatically frees itself.

The first channel has attached to the outer side thereof the flat rectangular base 34 of a guard latch 36. The guard latch has a pair of square holes 38. These match a similar pair of square holes, 40 indicated, in vertical series in the web 42 of the channel; the attachment is by carriage bolt type machine screws 44. These bolts have featureless semi-spherical outer head portions 46 integral with square inner-head portions 48 fitting the square holes and preventing turning. If the holes in the web should be oversize or rounded, the square holes in the guard latch could still prevent rotation which might otherwise result in loosening of nuts 50 on the machine screws, permitting removal of the fasteners, and then the grill. The nuts are preferably of suitable commercially available self-locking type.

The base 34 fits in the channel and the ends of the screws and the nuts also. An integral angle has a first leg 52 perpendicularly joining the base 34 and a second leg 54 at right angles to the first leg extending beyond the channel parallel to the base of the guard latch. The base 34 of the guard latch and the nuts 50 on the screws are tamper-protected when covered by frame latch 56, a "T" shaped member of flat steel plate like the guard latch; the guard latch has a padlock hole 58 in the bottom of the shank 53 of the "T" shape matching a hole 60 in the second leg 54 of the angle.

Screws 62 through holes in the crossbar of the "T"-shape attach it to the window frame F. A padlock, not shown, secures through the matching holes for locking the window guard assembly in place. The channel 22 prevents access to the nuts 50 and screws 62 when the grill is locked in place.

The second channel 24 has at the top and at the bottom respective flat steel plate hinge-hooks 64, each with a base 66 similarly secured through a square hole 68 in it inside the channel recess by a fastener 70 similar to the fasteners holding the guard latch, to which the structures are analogous. Each hinge hook has parallel top and bottom and is of square "Z" shape, with a first angular portion 72 extending perpendicularly from the base parallel with the legs of the channel and then when outside the channel, a leg turning at right angles and extending generally parallel with the base as a free end or second angular portion 74 past the front of the channel, leaving a space between the second angular position and the channel of little more than the thickness of the second angular portion.

Each hinge hook engages a respective hinge catch plate 76, fastened to the window frame F, like the frame latch and parallel to it, by means such as screws 62 in position to receive one of the second angular portions 74 in a respective rectangular vertical slot 78 in the outer portion of each hinge plate. This arrangement covers and protects the releasible hinging mechanism fasteners in similar manner to that described in reference to the locking mechanism, while providing for secure hinging and for instant removal when the unit is unlocked.

Figure 2:
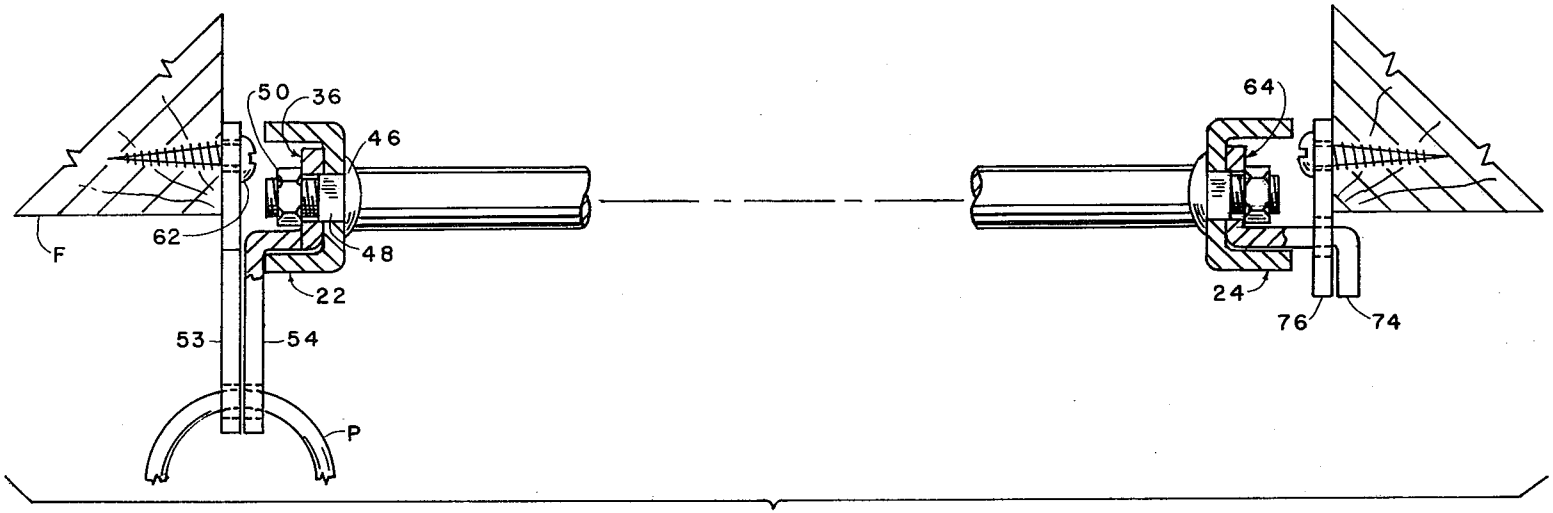
FIG. 2 is a plan fragmentary detail, partly in section, showing self-protective assembly relation of the invention when installed in a window frame.

FIG. 2 shows the assembled relations of details of the invention when locked in place.

The nuts 50 and screws 62 are completely inaccessible to tampering, shielded by the adjacent structures so that they cannot be readily seen, much less removed. The rounded heads 46 of the bolts offer no good point of attack, and the bolt inner head portion square shanks 48 which preferably extend into the square holes of the members 36 and 64 further prevent tampering.

The offset of the hinge hook portions can be just sufficient to accommodate the hinge catch plate thickness between them and the channel 24.

P indicates a padlock, shown locked.

A would-be intruder who tried to saw through either the paired protrusions 53, 54 at the padlock or the paired protrusions 74, 76 at the hinges, would find that flexure between the protrusions would tend to bind the saw, and could emit loud sounds during the attempt.

Such units can be installed easily if the guard latch and hinge hooks are pre-assembled and then used as templates to mark location for the matching parts.

To prevent rattling it is evident that a slight bend of the hinge hooks changing the inclined relation of the hinge parts by tending to pivot the grill outward can produce a resiliently tight fit when the unit is closed and locked.

If the grill is slidably expandable in size as indicated that can make installation easier, but installation is not, in any case, difficult. The average business man or home owner can easily install his own because, for example, tolerances are loose, and the channels square the parts connected to them. Full access for escape, for window washing, or for painting or for passage of bulky items, is always available.

The design is adaptable to fit almost any grill with channels like those illustrated and the latch and hinge structures as sub-assemblies can be supplied economically in kit form.

It will be appreciated that although this description has mentioned buildings, analogous installations can be made in vehicles and other enclosures without departing from principles of the invention.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. In a system having means for hinging and locking grills over openings at window frames and the like, the improvement comprising: the means for hinging having means for fastening a said grill to a window frame, including means for freeing a said grill from a window frame on hingedly pivoting a grill to an open position relative to a window frame; the means for locking having respective means for attachment to a window frame and to a said grill; means for protecting all said fastening means from tampering when a said grill is hinged and locked to a window frame; said means for hinging including: a plurality of hinge hooks, said means protecting including each hinge hook having a first portion proportioned for fitting a recess in a side of a said grill, a second portion extending at an angle from the first portion and a third portion extending from the second portion in a direction generally parallel with the first portion, means for fastening each hinge hook to a said grill; a respective hinge catch plate for each hinge hook, means for fastening, each hinge catch plate to a said window frame, each said hinge hook third portion passing through a slot in a hinge catch plate with the hinge catch plate covering the hinge hook fastening means and the hinge hook covering the hinge catch plate fastening means, and the means for freeing further including each hinge hook third portion proportioned for free withdrawal from a said hinge catch plate when a said grill is at said open position.

2. In a system as recited in claim 1, said open position being with a said grill at substantially right angles to a said window frame.

3. In a system as recited in claim 2, said means for locking including a guard latch, the means for protecting including said guard latch having: a first part proportioned for fitting a recess in a side of a said grill, a second part extending at an angle from the first part and a third part extending from the second part in a direction generally parallel with the first part and means for fastening said guard latch to a said grill, said means for attachment to a window frame including a frame latch having proportion for protectively overlying the guard latch when installed on a window frame; said means for attachment facing, in said locked position, the guard latch first part; and the guard latch having a locking hole therein alignable with a locking hole in the frame latch, for said locking.

4. In a system having means for hinging and locking grills in place over openings at window frames and the like, the improvement comprising: the means for hinging having means for fastening a said grill to a window frame, including means for freeing a said grill from a window frame on hingedly pivoting said grill to an open position relative to said window frame; the means for locking including respective means for attaching to a window frame and to a said grill with respective means for securing together as by a padlock; means for protecting said means for hinging and means for locking from tampering when a said grill is hinged and locked in place; said means for fastening including: a slotted member for fixing to a window frame, an elongate member for fixing to a grill, the elongate member having a free end proportioned for passing through said slot; said slotted member and free end having an inclined relation, said means for freeing including the inclined relation preventing removal of said free end from said slot when a said grill is hinged and locked in place but permitting removal of said free end from said slot when a said grill is pivoted on the hinge means to a said open position relative to said window frame; said means for protecting from tampering including the elongate member having a base portion, said inclined relation offsetting said base portion generally parallel with said free end in location providing for bolting the base portion in a recess in a grill with a portion of said slotted member covering said recess and preventing access to an end of a said bolt; a carriage bolt and nut for bolting each of said base portion and offset base part to a grill; said means for protecting further including each carriage bolt having a rounded head with a square underhead portion, and each of said base portion and offset base part having a square recess therein for retaining a said carriage bolt against rotation when a said grill is hinged and locked in place.

* * * * *